US006626102B2

(12) United States Patent
Tokiwa

(10) Patent No.: US 6,626,102 B2
(45) Date of Patent: Sep. 30, 2003

(54) SYNCHRONOUS CONTROL SYSTEM HAVING AUTOMATIC CUTTING AND PRINTING REGISTERING FUNCTIONS

(75) Inventor: Shizurou Tokiwa, Kotubo Zushi (JP)

(73) Assignee: Tokyo Kikai Seisakusho, Ltd. (JP)

( * ) Notice: Subject to any disclaimer, the term of this patent is extended or adjusted under 35 U.S.C. 154(b) by 0 days.

(21) Appl. No.: 10/367,499

(22) Filed: Feb. 14, 2003

(65) Prior Publication Data

US 2003/0136283 A1 Jul. 24, 2003

Related U.S. Application Data

(63) Continuation of application No. 09/886,442, filed on Jun. 21, 2001.

(30) Foreign Application Priority Data

Jun. 23, 2000 (JP) ..... 2000/188844

(51) Int. Cl.[7] ..... B41F 13/56
(52) U.S. Cl. ..... 101/226; 101/171; 101/181
(58) Field of Search ..... 101/226, 171, 101/181

(56) References Cited

U.S. PATENT DOCUMENTS

| | | | | |
|---|---|---|---|---|
| 1,993,579 A | | 3/1935 | Wright | |
| 5,309,834 A | | 5/1994 | Koch | |
| 5,617,788 A | * | 4/1997 | Horiguchi et al. | 101/181 |
| 5,647,582 A | | 7/1997 | Shiba | |
| 6,305,857 B1 | * | 10/2001 | Crowley et al. | 400/579 |
| 6,343,549 B1 | * | 2/2002 | Tokiwa | 101/248 |
| 6,354,214 B1 | * | 3/2002 | Tokiwa | 101/484 |
| 2002/0111696 A1 | * | 8/2002 | Albrecht et al. | 700/3 |

FOREIGN PATENT DOCUMENTS

| | | |
|---|---|---|
| DE | 195 09 947 | 9/1996 |
| EP | 0 699 524 | 3/1996 |
| EP | 0 930 552 | 7/1999 |
| JP | 6(1994)-47905 | 4/1993 |
| JP | 2866071 | 3/1999 |
| WO | WO 97/11848 | 4/1997 |

* cited by examiner

*Primary Examiner*—Charles H. Nolan, Jr.
(74) *Attorney, Agent, or Firm*—McGlew and Tuttle, P.C.

(57) ABSTRACT

The present invention is intended to automatically adjust cutting and printing registers based on the detection of predetermined mark for different colors in a rotary press using a paper web, thereby eliminating the need for skills and reducing time for adjusting cutting registers. A driving reference setting section, a feedback signal output section, a mark detecting section and a register correction value output section are provided, and a control section for controlling the driving section of the printing mechanism effects control so that the driving reference phase is synchronized with the feedback phase of the plate cylinder by each driving means.

8 Claims, 9 Drawing Sheets

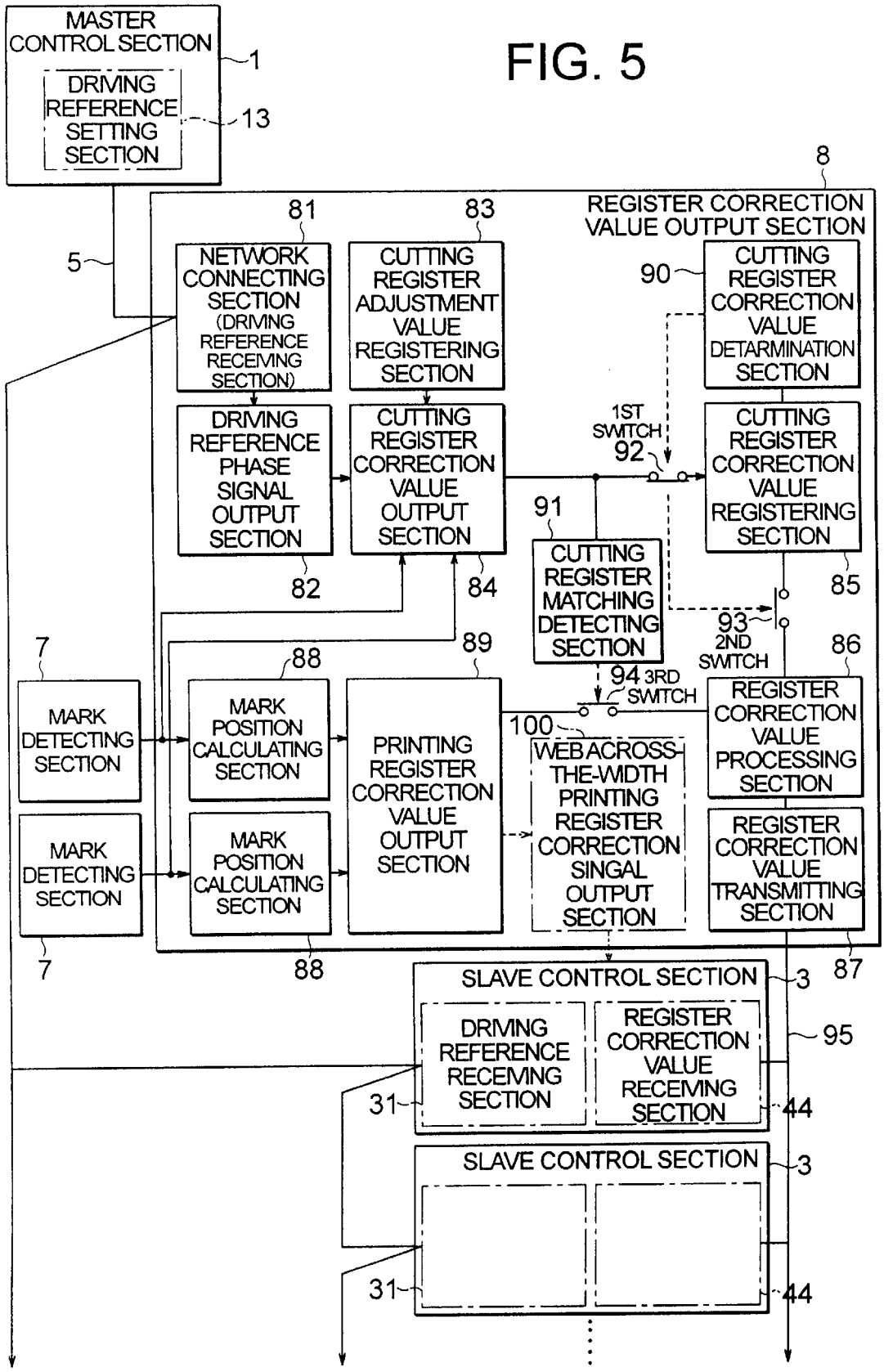
FIG. 5
MASTER CONTROL SECTION
1
DRIVING REFERENCE SETTING SECTION
13
8
REGISTER CORRECTION VALUE OUTPUT SECTION
5
81
NETWORK CONNECTING SECTION (DRIVING REFERENCE RECEIVING SECTION)
83
CUTTING REGISTER ADJUSTMENT VALUE REGISTERING SECTION
90
CUTTING REGISTER CORRECTION VALUE DETARMINATION SECTION
DRIVING REFERENCE PHASE SIGNAL OUTPUT SECTION
CUTTING REGISTER CORRECTION VALUE OUTPUT SECTION
1ST SWITCH
92
CUTTING REGISTER CORRECTION VALUE REGISTERING SECTION
91
82
84
CUTTING REGISTER MATCHING DETECTING SECTION
85
93
2ND SWITCH
86
7
88
89
94
3RD SWITCH
MARK DETECTING SECTION
MARK POSITION CALCULATING SECTION
PRINTING REGISTER CORRECTION VALUE OUTPUT SECTION
100
WEB ACROSS-THE-WIDTH PRINTING REGISTER CORRECTION SINGAL OUTPUT SECTION
REGISTER CORRECTION VALUE PROCESSING SECTION
MARK DETECTING SECTION
MARK POSITION CALCULATING SECTION
REGISTER CORRECTION VALUE TRANSMITTING SECTION
7
88
87
SLAVE CONTROL SECTION
3
DRIVING REFERENCE RECEIVING SECTION
REGISTER CORRECTION VALUE RECEIVING SECTION
95
31
44
SLAVE CONTROL SECTION
3
31
44

FIG. 7

| | | |

SYNCHRONOUS CONTROL SYSTEM HAVING AUTOMATIC CUTTING AND PRINTING REGISTERING FUNCTIONS

This is a continuation of application Ser. No. 09/886,442 filed Jun. 21, 2001, and the entire disclosure of this prior application is considered to be part of the disclosure of the accompanying application and is hereby incorporated by reference therein.

BACKGROUND OF THE INVENTION

The present invention relates generally to a synchronous control system for rotary presses having a registering function for adjusting cutting registration and at least longitudinal printing registration among longitudinal and across-the-width printing registration on a paper web, and more particularly to a synchronous control system for rotary presses for multi-color printing on a paper web with a plurality of printing mechanisms driven by independent driving means and cutting the multi-color printed paper web into predetermined printing image units with cutting mechanisms driven by independent driving means, in which cutting registration and at least longitudinal printing registration among longitudinal and across-the-width printing registration on a paper web are adjusted by synchronously controlling independent driving means for printing and cutting mechanisms.

PRIOR ART

What can be considered a synchronous control system for adjusting cutting registration and at least longitudinal printing registration on a paper web, among longitudinal and across-the-width printing registration, for a rotary press for performing multi-color printing on the web with a plurality of printing mechanisms driven by independent driving means, and cutting the multi-color printed web into predetermined printing image units with cutting mechanisms driven by independent driving means is disclosed in Japanese Patent Application Laid-Open No. 6(1994)-47905.

Synchronous control system for similar rotary presses for adjusting at least longitudinal printing registration among longitudinal and across-the-width printing registration on a paper web includes that disclosed in Japanese Patent Publication No. 2866071.

The synchronous control system for rotary presses disclosed in Japanese Patent Application Laid-Open No. 6(1994)47905 has independent driving sections (motors) for driven sections (cylinders) of printing units, and drive control systems for each of the independent driving sections, and it discloses the sections are grouped into printing station groups. Some of the printing station groups are independent from each other, and receive their respective positional references via data buses allocated to the printing station groups. That is, the printing station groups have their respective drive units; each drive unit is connected to a data bus to which a folding unit is connected and controlling the positioning of the individual driving sections for that printing station group and the relative positioning of the individual driving sections.

A control/data processing unit as a high-order master device is connected to the data bus to which the drive unit is connected. This control/data processing unit performs the presetting of target values and target-value deviations, and the processing of actual values, thereby performing target-value control for different printing station groups in such a manner as to maintain coordination among the printing station groups and with the folding unit.

In other words, this rotary press performs the control of operation for each motor of the printing station groups based on the control references given by the drive units and the high-order master device via drive control devices, taking into account the relations with the positional references received from the folding unit.

The synchronous control system of rotary presses disclosed in Japanese Patent Publication No. 2866071 has independent driving means for driving plate cylinders of a plurality of printing units provided for multi-color printing on a paper web, and controls the operation of the plate cylinders by the driving means by feeding back the operating state of the driving means to correct instruction values relating to the drive control using the feedback signal. The synchronous control system also has a control section that reads predetermined marks printed the multi-color printing plate cylinders, detects and calculates shifts in printing images printed by the plate cylinders, and outputs signals corresponding to the shifts. When the instruction values are corrected by the feedback signals, as noted earlier, the instruction values are also corrected by the signals output by the control section, so that the shifts in the longitudinal direction of the paper web with respect to printing images are automatically adjusted.

The synchronous control system for rotary presses disclosed in Japanese Patent Publication No. 2866071 has a plate cylinder axial adjustment mechanism for moving a plate cylinder in the axial direction so that the shifts in the across-the-width direction of the paper web with respect to printing images can be automatically adjusted. The operation of the driving means for the plate cylinder axial adjustment mechanism is controlled based on the signals relating to the axial adjustment of the plate cylinders output by the control section.

Japanese Patent Application Laid-Open No. 6(1994)-47905 gives only a rough outline of the construction and operation of the invention, and does not disclose specific details of control.

For example as for the control of the positioning of individual driving sections in the printing station groups and the control of the mutual positioning between individual driving sections in relation to the positional reference received from the folding unit, it is not disclosed clear for what and how the control is embodied. Even if the control is for correctly matching the mutual relation of printing images, and for correctly controlling the relation of the printing image and cutting/folding, it is not disclosed clearly how the control is embodied.

Although the system disclosed in Japanese Patent Publication No. 2866071 is capable of automatically adjusting printing registration on printing images, does not deal with the automatic adjustment of cutting registration. Cutting registration has therefore been adjusted in the prior art by sampling printed matter after cutting, determining by visual inspection a printing image of a reference color or printing images of various other colors on the sampled printed matter, and adjusting cutting registration, that is, the relationship between the cutting positions and the printing images. This work has involved considerable degrees of skill and time, and a relatively large amount of spoilage has been produced during visual registration adjustment.

The present invention makes it possible, in a rotary press using a paper web, to automatically adjust both cutting registration where the web cutting position by a folding unit or sheeter is adjusted to a proper position with respect to the printing position, and printing registration where accurate superimposition of printing images of different colors is maintained in multi-color printing, based on the detection of predetermined register marks of different colors printed together with the printing images of various colors. The present invention is also intended to eliminate the need for skill, reduce time for cutting registration, and minimize spoilage involved with this work.

SUMMARY OF INVENTION

It is an object of the present invention to solve the problems inherent in the prior art.

It is another object of the present invention, in a rotary press using a paper web, to continuously perform the automatic adjustment of both cutting registration where the web cutting position by a folding unit or sheeter is adjusted to a proper position with respect to the printing position and printing registration where accurate superimposition of printing images of various colors is maintained in multi-color printing, based on the detection of predetermined register marks.

It is a further object of the present invention to eliminate the need for skill and reduce time for both cutting and printing registration, thereby reducing spoilage involved with cutting and printing registration.

The present invention calculates a difference in length between the actual cutting position on a paper web and the correct cutting position on the web when the register mark is detected in the state where the driving means are synchronously controlled in accordance with the driving reference, based on the relationship of the length of the web between a predetermined correct position on the web and the actual cutting position of a cutting mechanism, and determines a cutting registration value for adjusting the driving reference phase and presets the value in a register correction value output section. In this state, the driving reference setting section is actuated.

A control section then receives a driving reference, and also receives a feedback signal in accordance with a driving reference speed and a driving reference phase in the driving reference received, thereby operating the rotary press by actuating the driving means while confirming the driving state.

As the rotary press is operated, the printing mechanism prints a register mark, which is detected by a mark detecting section. Upon detection of the mark, the mark detecting section outputs a detection signal.

As the driving reference setting section is operated, the rotary press is also operated and the mark detecting section outputs a detection signal, the register correction value output section receives a driving reference phase, adjusts the driving reference phase with the cutting registration adjustment value, registers the value obtained by adjusting the driving reference phase with the cutting register correction value, set the registered value as a cutting register correction value, and transmits the cutting register correction value as a register correction value to the control section of the printing mechanism. Furthermore, a shift between the correct position of the mark and the actual position with respect to the reference mark is obtained as a printing register correction value.

Upon receipt of the register correction value from the register correction value output section, the printing mechanism control section corrects the driving reference phase with the register correction value to obtain a corrected driving reference phase, replaces the driving reference phase with the corrected driving reference phase, and operates the driving means in accordance with the driving reference speed and the corrected driving reference phase, while receiving feedback signals to confirm the driving state. The cutting mechanism control section operates the driving means in accordance with the driving reference speed and the driving reference phase, while receiving feedback signals to confirm the driving state as before.

Along with this drive control, the rotational phase of the printing mechanism is corrected with respect to the rotational phase of the cutting mechanism, the actual cutting position on the web agrees with the correct cutting position on the web, and the value obtained by adjusting the driving reference phase with the cutting register correction value at the point of time when the mark detecting section outputs a detection signal, output by the register correction value output section becomes zero. Then, the register correction value output section replaces the previous register correction value involving only the cutting register correction value with a new register correction value obtained by merging both the cutting register correction value and the printing register correction value, and transmits the replaced register correction value to the printing mechanism control section.

Upon receipt of the new register correction value involving both the cutting and printing register correction values from the register correction value output section, the printing mechanism control section corrects the previous corrected driving reference phase with the new register correction value into a new corrected driving reference phase, replaces the corrected driving reference phase with the new corrected driving reference phase, and operates the driving means in accordance with the driving reference speed and the new corrected driving reference phase while receiving feedback signals to confirm the driving state. The cutting mechanism control section, on the other hand, operates the driving means in accordance with the driving reference speed and the driving reference phase while receiving feedback signals to confirm the driving state as before.

With this drive control, the rotational phases of the printing mechanisms of other marks are corrected with respect to the rotational phase of the printing mechanism of the reference mark, and thereby the positions of other marks with respect to the reference mark printed on the web agree with their respective correct positions.

The control section thereafter continues control to operate the driving means in accordance with the driving reference speed and the new corrected driving reference phase while receiving feedback signals to confirm the driving state.

BRIEF DESCRIPTION OF THE DRAWINGS

FIG. 5 is a diagram of assistance in explaining a register correction value output section.

FIG. 7 is a diagram of assistance in explaining a control message for the integrated value of a speed setting section and a phase setting section.

BEST MODE FOR CARRYING OUT THE INVENTION

In the following, an embodiment of the present invention will be described with reference to the accompanying drawings.

Figure 1:
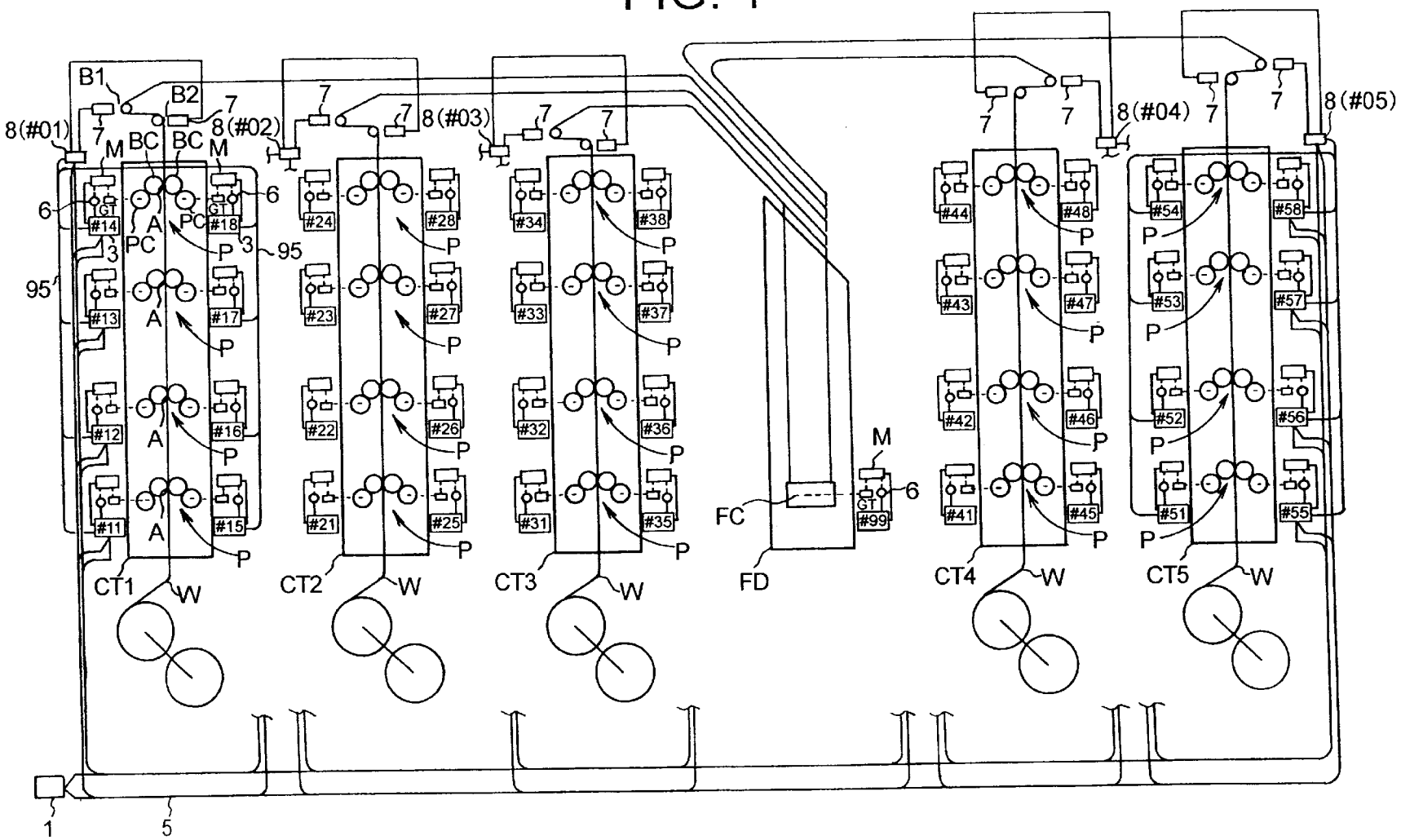
FIG. 1 is a diagram of assistance in explaining a rotary press in an embodiment of the present invention.

FIG. 1 is a diagram of assistance in explaining a rotary press in an embodiment of the present invention.

FIG. 1 shows a rotary press comprising printing units CT1, CT2, CT3, CT4 and CT5 each having four printing mechanisms P, and a folding unit FD that is a cutting mechanism that cuts and folds a printed paper web W into predetermined printing images, to which the synchronous control system having automatic cutting and printing registration functions according to the present invention.

Each printing mechanism P of the printing units CT1, CT2, CT3, CT4 and CT5 has two sets of printing couples consisting of a blanket cylinder BC and a plate cylinder PC. Each printing couple is driven by a driving means M; the plate cylinder is driven via a transmission means GT and the blanket cylinder BC is driven via a transmission means (not shown) provided between the plate cylinder PC and the blanket cylinder BC.

That is, each of the printing mechanisms P of the printing units CT1, CT2, CT3, CT4 and CT5 is driven by an independent driving means M. The folding cylinder FC of the folding unit FD is driven by a driving means M via a transmission means GT and other cylinders via a transmission means (not shown) provided between the folding cylinder FC and the other cylinders. There can be an arrangement where the transmission means GT is omitted, and the plate cylinder PC and the folding cylinder FC are directly driven by driving means M.

The driving means M has slave control sections 3 (#11~#18, #21~#28, #31~#38, #41~#48, #51~#58, and #99) corresponding to the driving means, and a rotary encoder with Z phase 6 (incremental encoder; hereinafter referred to as encoder) that outputs first pulse signals (hereinafter referred to as pulse signals) of a quantity proportional to the amount of rotational angular displacement of the M, and a second pulse signal (hereinafter referred to as Z-phase pulse signal) for one turn of the driving means M.

The slave control section 3 is connected to a network line 5 via a slave network connecting section 31, which will be described later with reference to FIG. 3 (the state of connection between the slave control sections 3 of #15~#18, #21~#28, #31~#38, #41~#48, #51~#54, and #99 and the network line 5, which is the same as that of the slave control sections 3 of #11~#14, and #55~#54, is not shown in the figure). The network line 5 is connected to the master control section 1.

Furthermore, mark detecting sections 7, 7 for detecting predetermined marks, such as register marks, printed on a paper web W are provided facing the top and bottom surfaces of the web W on the downstream side of the most downstream side printing mechanisms P of the printing units CT1, CT2, CT3, CT4 and CT5, and register correction value output sections 8 connected to a pair of mark detecting section 7, 7 and to the slave control sections 3 of the printing units CT1, CT2, CT3, CT4 and CT5 and the master control section 1 are provided.

The mark detecting sections 7, 7 are capable of individually detecting register marks printed on the web W by the plate cylinder PC of each printing mechanism P, and the register correction value output section 8 is capable of outputting a register correction value for each register mark detected individually.

The register marks detected by the mark detecting sections 7, 7 are usually printed at locations not included in the normal printing images. In this embodiment, register marks should preferably be printed at locations where there is no printing images in the longitudinal direction of the web, that is, on white margins on both sides or on the central folding zone.

The network line 5 is formed into a loop, so that when any one of the network line 5 fails, signal transmission between the master control section 1 and the slave control sections 3 of#11~#18, #21~#28, #31~#38, #41~#48, #51~#58, and #99 can be maintained using the other of the network line 5.

There can be a construction where a plurality of master control sections are provided in place of the master control section 1; each of the master control sections has the functions of the master control section, which will be described later, and is usable by selectively changing over them.

A mechanism for adjusting printing registers in the across-the-width direction of the web (not shown in the figure) may be provided on the plate cylinder PC of each printing mechanism P. This web across-the-width direction printing register adjustment mechanism is provided so as to adjust printing registers with an appropriate correction signal output by a register correction value output section 8, which will be described later.

Figure 2:
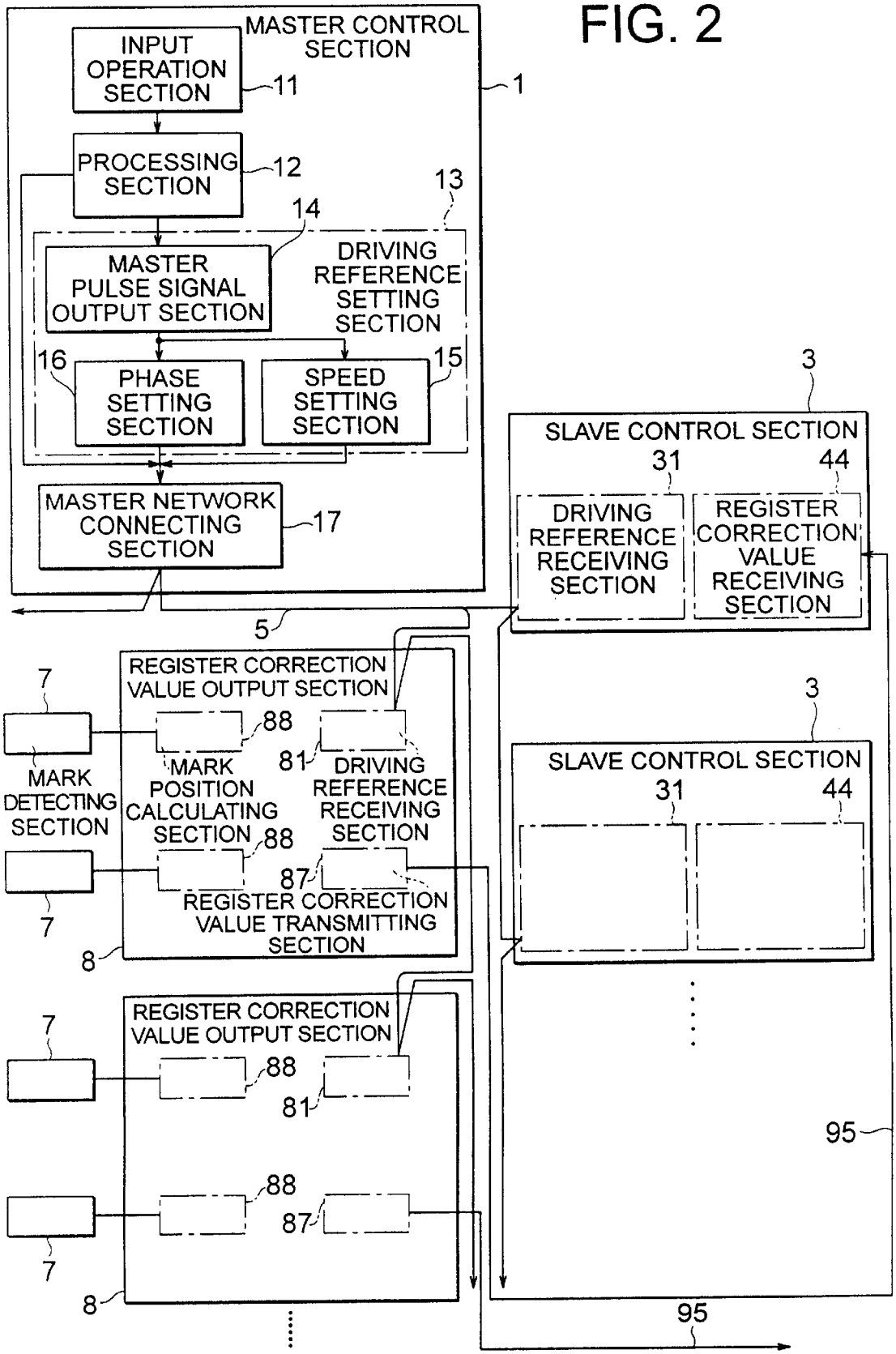
FIG. 2 is a diagram of assistance in explaining a master control section.

FIG. 2 is a diagram of assistance in explaining the master control section 1. In FIG. 2, an input control section 11, a driving reference setting section 13, a processing section 12, and a master network connecting section 17 are provided in the master control section 1. The driving reference setting section 13 has a master pulse signal output section 14, a speed setting section 15, and a phase setting section 16.

The input control section 11 is capable of performing initial control to input set organization information, such as designation of printing units to be used during printing operation from the printing units CT1, CT2, CT3, CT4 and CT5, and performing operation control to input operation signals, such as start, acceleration/deceleration, and stop.

The processing section 12 prepares control range designation and other messages by organizing rotary press sets based on the set organization information input by the input control section 11 to prepare control range designation and other messages, and is capable of performing operation control instructed by the input control section 11 so that the organized sets can be synchronously controlled, and setting a driving reference based on these operations.

The master network connecting section 17 transmits a control range designation message prepared by the processing section 12 and a control message relating to the driving reference set by the driving reference setting section 13 to the network line 5, and receives a response message on response information sent by the slave control section 3 via the network line 5.

The master pulse signal output section 14 outputs a first master pulse signal proportional to a speed value set by the processing section 12 based on operation signals, such as start, acceleration/deceleration and stop, input by the input control section 11, and a second master pulse signal every time a predetermined number of the first master pulse signals are output. These first and second master pulse.signals are signals having a frequency equal to the pulse signal output by the encoder 6 provided corresponding to each driving means M and the Z-phase pulse signal output by the encoder 6 when the printing mechanism P is operated at a set speed.

The speed setting section 15 sets a driving reference speed for the driving means M based on the first master pulse signal output by the master pulse signal output section 14.

The phase setting section 16 sets a driving reference phase for the driving means M and the plate cylinder PC as a driven component of the driving means M based on the first and second master pulse signals output by the master pulse signal output section 14.

Figure 3:
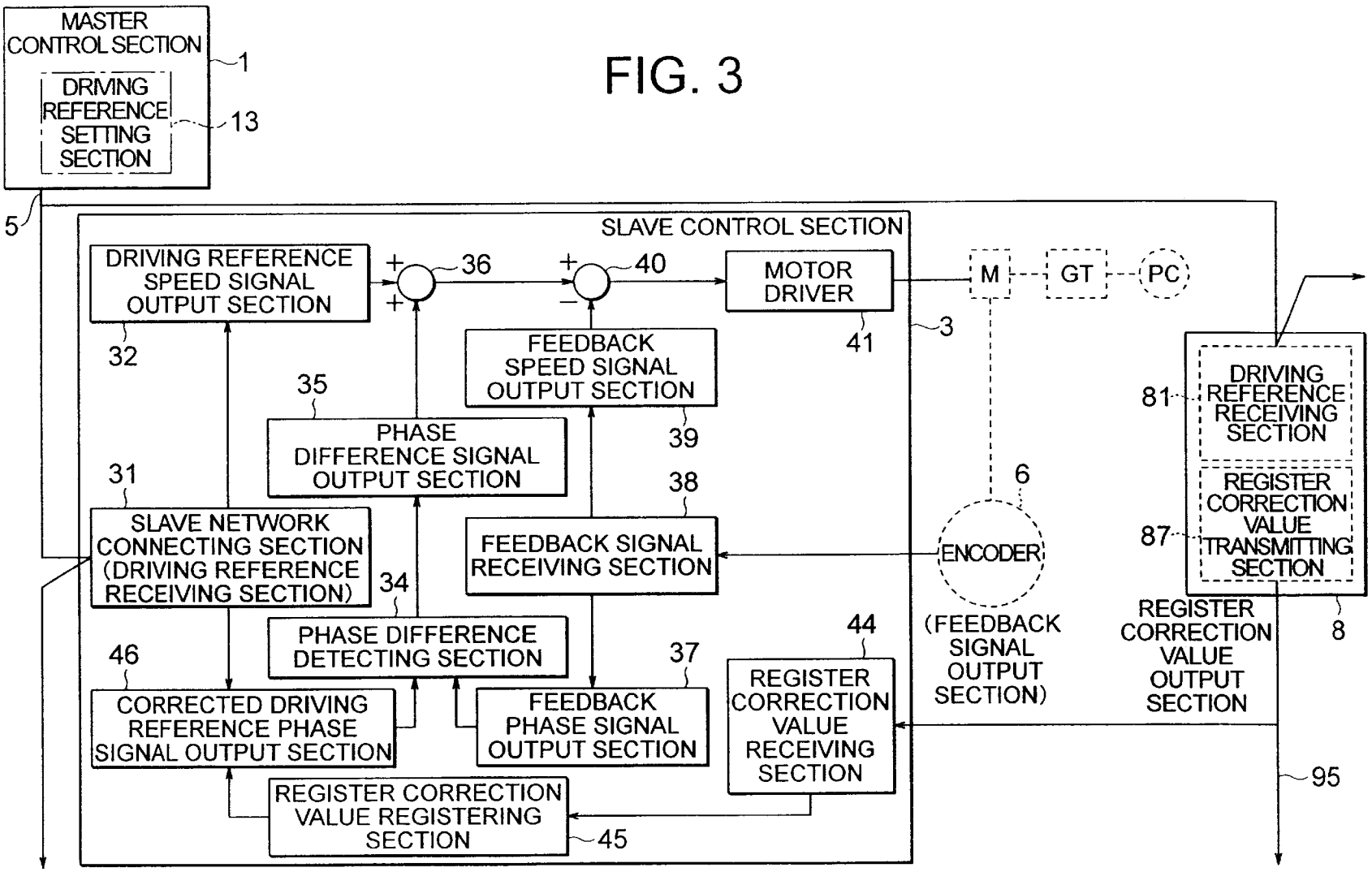
FIG. 3 is a diagram of assistance in explaining a slave control section corresponding to a driving means of the printing mechanism.

FIG. 3 is a diagram of assistance in explaining the slave control section 3 corresponding toe the driving means of the printing mechanism. In FIG. 3, the slave control section 3 has a slave network connecting section 31 that also serves as a driving reference receiving section, a driving reference speed signal output section 32, a register correction value registration section 45, a corrected driving reference phase signal output section 46, a register correction value receiving section 44, a feedback signal receiving section 38, a feedback speed signal output section 39, a feedback phase signal output section 37, a phase difference detecting section 34, a phase difference signal output section 35, a first speed signal correction section 36, a second speed signal correction section 40, and a motor driver 41.

The slave network connecting section 31 is a microcomputer having an interface that receives a control range designation message comprising set organization information sent by the master control section 1, and a control message of the driving reference consisting of a driving reference speed and a driving reference phase via the network line 5, and transmits to the master control section 1 a response message acknowledging the receipt of the message from the master control section 1 via the network line 5 as necessary.

The register correction value receiving section 44 receives a control message that is a register correction value transmitted by the register correction value output section 8 via a transmission line 95, and inputs the register correction value to the register correction value registration section 45.

The register correction value registration section 45 registers a register correction value input by the register correction value receiving section 44, and can output it to the corrected driving reference phase signal output section 46.

The driving reference speed signal output section 32 converts a driving reference speed in a control message into an analog driving reference speed signal proportional to the speed value input by the input control section 11 and set by the processing section 12, and outputs it.

The corrected driving reference phase signal output section 46 corrects the driving reference phase using the register correction value registered in the register correction value registration section 45 into a corrected driving reference phase and outputs it as a driving reference phase in the form of an appropriate signal every time the driving reference phase of the control message is input.

The feedback signal receiving section 38 receives the pulse signal and Z-phase pulse signals output by the encoder 6 corresponding to the driving means M.

The feedback speed signal output section 39 calculates a value proportional to the rotational speed of the driving means M based on the pulse signal output by the encoder 6, and converts the calculated value into an analog driving speed signal proportional to the rotational speed of the driving means M and outputs it.

The feedback phase signal output section 37 detects a feedback phase of the driving means M, and the plate cylinder PC that is a driven component of the driving means M from the pulse signal and the Z-phase pulse signal output by the encoder 6, and outputs it in the form of an appropriate signal.

The phase difference detecting section 34 detects a feedback phase difference of the plate cylinder PC with respect to the corrected driving reference phase from the corrected driving reference phase signal output by the corrected driving reference phase signal output section 46 and the feedback phase signal of the plate cylinder PC output by the feedback phase signal output section 37.

The phase difference signal output section 35 is a proportional integration amplifier that converts the difference detected by the phase difference detecting section 34 into an analog phase difference signal and outputs it.

The first speed signal correction section 36 corrects the driving reference speed signal output by the driving reference speed signal output section 32 using a phase difference signal output by the phase difference signal output section 35.

The second speed signal correction section 40 corrects the first corrected speed signal corrected by the first speed signal output section 36 using a driving speed signal for the driving means M output by the feedback speed signal output section 39.

The motor driver 41 supplies driving power to the driving means M based on the second corrected speed signal corrected by the second speed signal output section 40.

Consequently, the slave control section 3 corresponding to the driving means M of the printing mechanism synchronously controls the corresponding driving means M so that the plate cylinder PC matches with the corrected driving reference phase.

Figure 4:
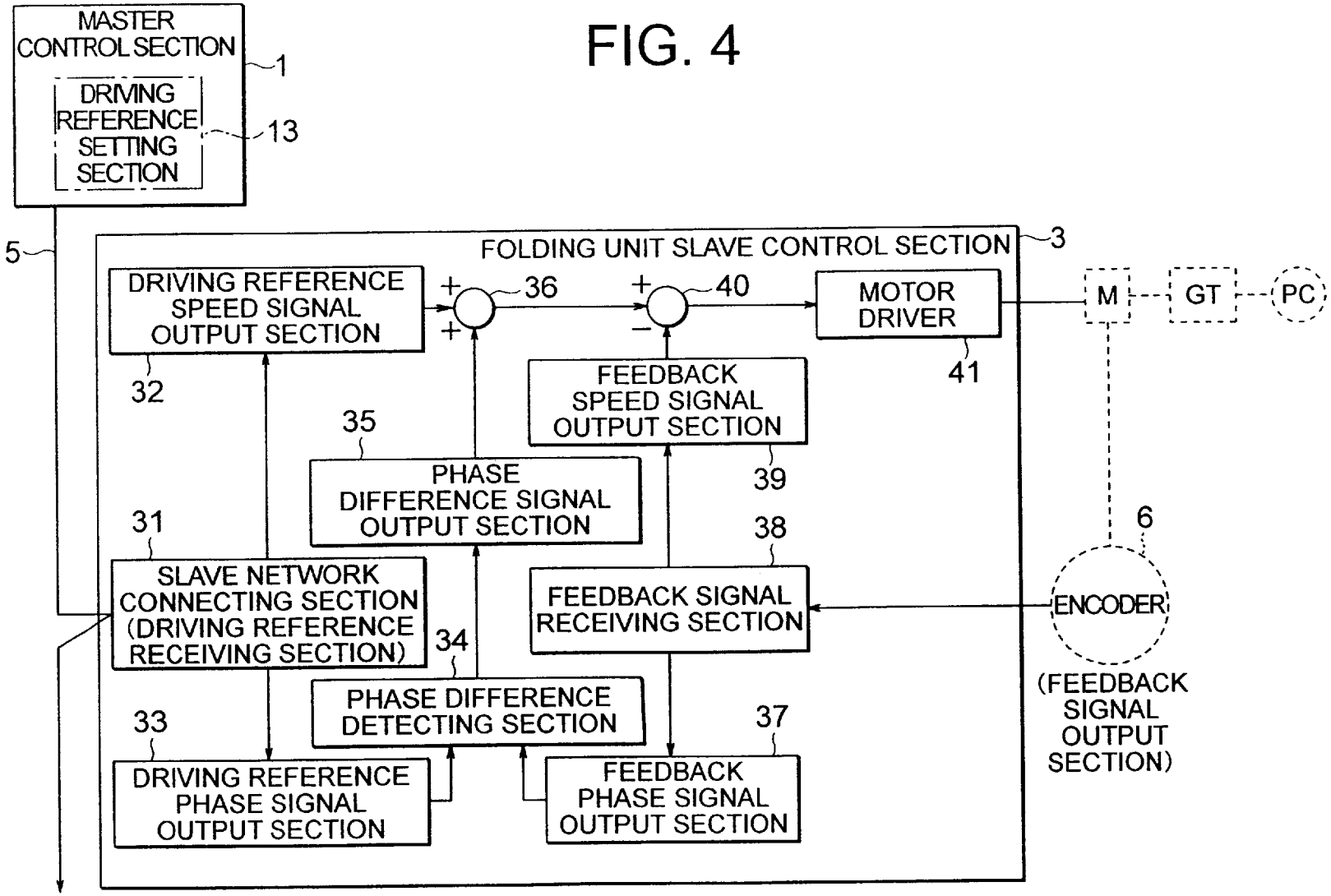
FIG. 4 is a diagram of assistance in explaining a slave control section corresponding to a driving means of a cutting mechanism (a pair of a folding cylinder and a saw cylinder of a folding unit in this embodiment).

FIG. 4 is a diagram of assistance in explaining the slave control section 3 of #99 corresponding to the driving means M for the cutting mechanism (a pair of a folding cylinder FD and a saw cylinder in this embodiment). In FIG. 4, the slave control section 3 has a slave network connecting section 31 that also serves as a driving reference receiving section, a driving reference speed signal output section 32, a driving reference phase signal output section 33, a feedback signal receiving section 38, a feedback speed signal output section 39, a feedback phase signal output section 37, a phase difference detecting section 34, a phase difference signal output section 35, a first speed signal correction section 36, a second speed signal correction section 40, and a motor driver 41.

Among these components, those having the same reference numerals as the components of the slave control section 3 corresponding to the driving means M of the printing mechanism described with reference to FIG. 3 are the same construction and operation with those described above. Description of these components are therefore omitted here.

The driving reference phase signal output section 33 receives the driving reference phase of the control message, and outputs it in the form of an appropriate signal every time the driving reference phase is input.

The feedback phase signal output section 37 shown in FIG. 4 is essentially the same as the feedback phase signal output section 37 described with reference to FIG. 3, except that the feedback phase signal output section 37 of FIG. 4 detects the feedback phase of the driving means M, and the cutting operation section (the folding cylinder FC of the folding unit in this embodiment) that is a driven part of the driving means M from the pulse signal and Z-phase pulse signal output by the encoder 6, and outputs it in the form of an appropriate signal.

The phase difference detecting section 34 detects the difference between the feedback phase of the folding cylinder FC and the driving reference phase from the driving reference phase signal output by the driving reference phase signal output means and the feedback phase signal of the folding cylinder FC output by the feedback phase signal output section 37.

Consequently, the slave control section 3 of #99 corresponding to the driving means M of the cutting mechanism (a pair of the folding cylinder FC and the saw cylinder of the folding unit in this embodiment) performs the synchronous control of the corresponding driving means M so that the folding cylinder FC matches with the driving reference phase.

FIG. 5 is a diagram of assistance in explaining the register correction value output section 8. In FIG. 5, the register correction value output section 8 has a network connecting section 81 that also serves as a driving reference receiving section, a driving reference phase signal output section 82, a cutting register adjustment value registering section 83, a cutting register correction value output section 84, a cutting register correction value registering section 85, a register correction value processing section 86, a register correction value transmitting section 87, a mark position calculating section 88 that is connected to the mark detecting section 7, a printing register correction value output section 89, a cutting register correction value determination section 90, a cutting register matching detecting section 91, a first switch 92 for intermittently making and breaking the connection between the cutting register correction value output section and the cutting register correction value registering section 85, a second switch 93 for intermittently making and breaking the connection between the cutting register correction value registering section 85 and the register correction value processing section 86, and a third switch 94 for intermittently making and breaking the connection between the printing register correction value output section 89 and the register correction value processing section 86.

Reference numeral 100 refers to a web across-the-width printing register correction signal output section that outputs a correction signal for adjusting printing register in the across-the-width direction of the web to a web across-the-width printing register adjustment mechanism. Since web across-the-width printing register adjustment using the web across-the-width printing register adjustment mechanism have no relations with the present invention, further description of it is omitted here.

The network connecting section 81 that also serves as a driving reference receiving section is a microcomputer including the interface for receiving a control range designation message comprising the set organization information transmitted by the master control section 1, and a control message of the driving reference having a driving reference speed and a driving reference phase via the network line 5, and transmits a response message acknowledging the receipt of a message from the master control section 1 as necessary. The register correction value output section 8 does not require any driving reference speed of the driving reference received by the network connecting section 81. Consequently, the driving reference control message may lack the driving reference speed.

The driving reference phase signal output section 82 receives the driving reference phase of the control message, and outputs it in the form of an appropriate signal every time it is input.

A cutting register adjustment value is set and registered in the cutting register adjustment value registering section 83, and the cutting register adjustment value registering section 83 outputs it in the form of an appropriate signal. The cutting register adjustment value used here is a value for correcting the length of the paper web W from the positions being detected B1 and B2 at which the register marks are detected by the mark detecting section 7 to the cutting position C at which a pair of the folding cylinder FC and the saw cylinder as a cutting mechanism in such a manner that the length of the web W becomes integral multiples of the length of a predetermined printing image unit (that is, an interval at which register marks are printed, or the cutting unit length). Consequently, the cutting register adjustment value may be the same value or a different value for register marks printed by any plate cylinders, depending on how the printing positions of the register marks are arranged in printing image setting, or how the register mark detecting positions for detecting the register marks are arranged.

Figure 9:
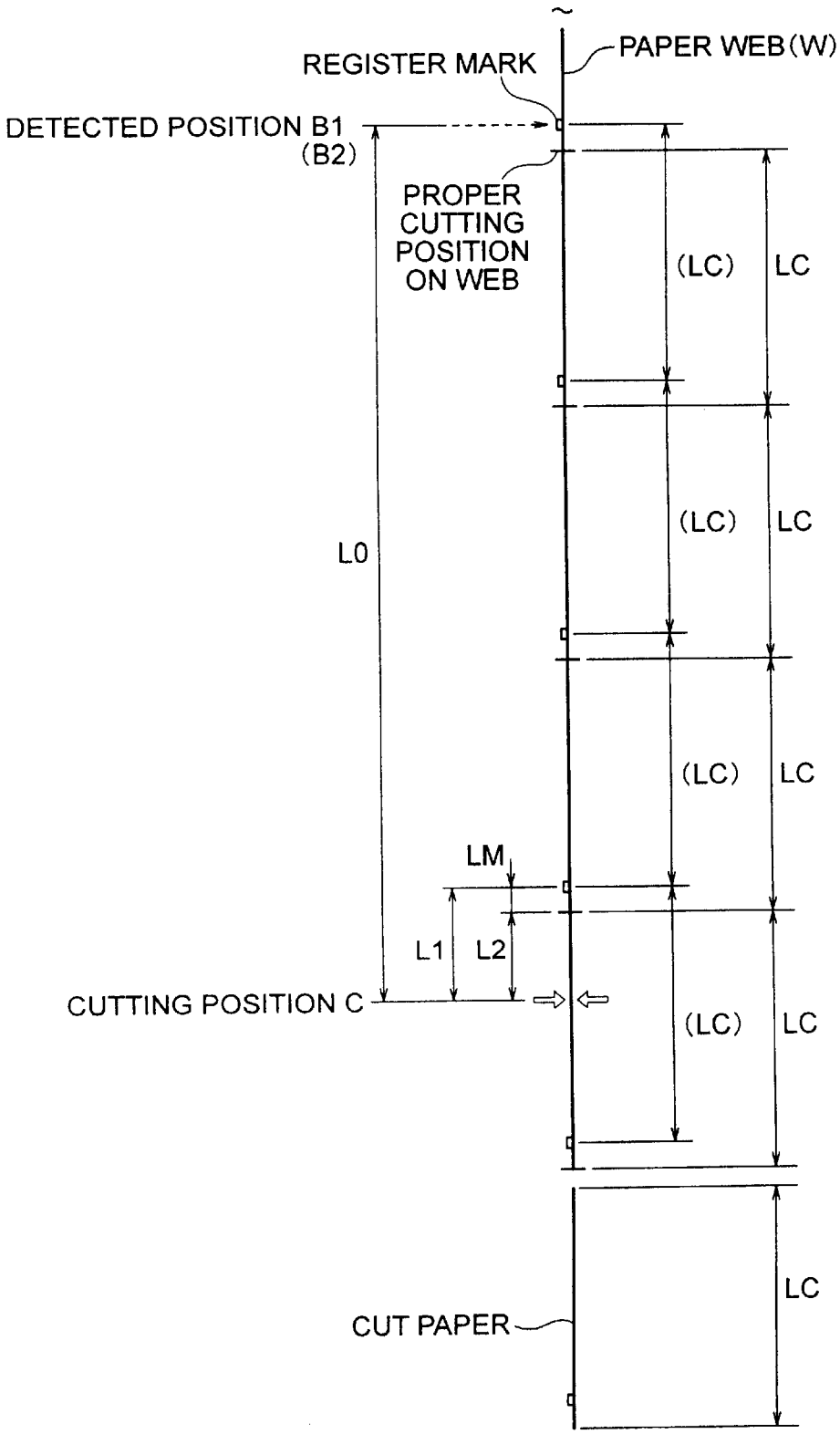
FIG. 9 is a diagram of assistance in explaining a cutting register adjustment value.

That is, as the outline is shown in FIG. 9 for convenience of explanation, the length L0 of the web W from the register detecting positions B1 and B2 for detecting the register marks to the cutting position C at which the web W is cut by the cutting mechanism is divided by a length LC of a predetermined printing image unit, a length L2 obtained by adding or subtracting a length LM from a proper cutting position on the web W to the nearest register mark printing position to or from the remaining length L1 obtained from the divisional calculation is replaced with a length on the outer periphery of the plate cylinder PC of the printing mechanism P. Further, the length L2 is replaced with the outer peripheral of the plate cylinder of the printing mechanism P, and a value N obtained by replacing the number of pulse signals of the feedback signal output section 6 corresponding to the length of the outer peripheral or the number of pulse signal and the Z-phase pulse signal of the feedback section 6 is set as a cutting register adjustment value. This cutting register adjustment value is output in the form of an appropriate signal every time the driving reference phase signal output section 82 outputs a signal.

When a register mark nearest to the cutting position is printed on the upstream of the proper cutting position on the web W, the correction value N is set by subtracting the length LM from the remaining length L1, and when a register mark nearest to the cutting position is printed on the downstream of the proper cutting position on the web W, adding the length LM to the length L1.

Every time the driving reference phase signal output section 82 outputs a driving reference phase signal, the cutting register correction value output section 84 adjusts the driving reference phase signal with the cutting register adjustment value of the cutting register adjustment value registring section 83, and the adjusted value is output in the form of an appropriate signal as the cutting register correction value for the plate cylinder PC that prints register marks every time the mark detecting section 7 detects a register mark.

The cutting register correction value registering section 85 registers the cutting register correction value output by the cutting register correction value output section 84 at a point of time when each register mark printed by the plate cylinder PC is detected by the corresponding mark detecting section 7. When registering the register marks, the cutting register correction value registering section 85 maintains the registration of the previously registered cutting register correction value instead of updating the cutting register correction value so long as the difference between a cutting register correction value being newly registered and the previously registered cutting register correction value does not exceed a predetermined range.

The cutting register correction value determination section 90 checks the cutting register correction value registering section 85 to see if the cutting register correction value is updated, and outputs a cutting register correction value determination signal to change over the first switch 92 and the second switch 93 if the updating of the cutting register correction value has not been successively carried out a predetermined number of times. That is, the state of the system at the start of control, which will be described later, is changed over, the connection between the cutting range correction value output section 84 and the cutting range correction value registering section 85 is cut off by turning "OFF" the first switch 92, and the cutting register correction value registering section 85 is connected to the register correction value processing section 86 by turning "ON" the second switch 93.

With this operation of the cutting register correction value determination section 90, a value that is different for each register mark is determined and registered. The cutting register correction value for each determined and registered register mark is a value that corrects the cutting register so that the length from the printing position A of the printing mechanism P printing each register mark to the positions B1 and B2 at which the marks are detected by the mark detecting sections 7 and 7 becomes integral multiples of the printing image unit length.

The register correction value processing section 86, when connected to the cutting register correction value registering section 85 by turning "ON" the second switch 93, outputs the cutting register correction value registered in the cutting register correction value registering section 85 as a register correction value in the form of an appropriate signal. Every time a printing register correction value, which will be described later, is input, this printing register correction value and the cutting register correction value are merged into a register correction value, and outputs it in the form of an appropriate signal.

The register correction value transmitting section 87 transmits an appropriate register correction value to the slave control section 3 of each printing mechanism P among the register correction values output by the register correction value processing section 86 via a transmission line 95.

The mark position calculating section 88, which is connected to the mark detecting section 7, calculates the barycentric position of each register mark printed by each printing mechanism P based on the detection signal of the mark detecting section 7, and outputs it in the form of an appropriate signal.

The printing register correction value output section 89 calculates how much the barycentric positions of other colors with respect to the barycentric position of a predetermined reference register mark (the register mark for black, for example) deviate from the positions where the barycenters of the register marks of the other colors should originally be located based on the signal output by the mark position calculating section 88, and the deviation obtained is output as a printing register correction value in the form of an appropriate signal.

A cutting register matching detection section 91, which is connected to the cutting register correction value output section 84, outputs a cutting register matching signal to turn "ON" a third switch 94 when the cutting register correction value output by the cutting register correction value output section 84 at the time when the mark detecting section 7 detects each register mark falls within a predetermined range including "zero," that is, when cutting register adjustment is completed as the cutting position on the paper web W almost agrees with the desired cutting position. When the third switch 94 is turned "ON" as the state at the start of control, which will be described later, is changed over, the printing register correction value output section 89 is connected to the register correction value processing section 86, and the printing register correction value as an output value of the printing register correction value output section 89 is input into the register correction value processing section 86 where it is processed as noted earlier. That is, the cutting register correction value and the printing register correction value are merged together.

In the following, control by a synchronous control system having cutting and printing register automatic adjusting functions according to the present invention will be described.

First, a cutting register adjustment value is set in the cutting register adjustment value registering section 83. Although this cutting register adjustment value is determined in terms of design in such a manner as described above, it is actually determined by taking into account errors caused in assembling printing units.

The cutting register adjustment value is the same for all the register marks so long as the printing image setting is such that register marks printed by the plate cylinders are printed at the same locations in the longitudinal direction of the web W, and the position of the mark detecting section 7 is set in such a manner as to detect marks at the same position in the web traveling direction on the web traveling path.

In the foregoing, description was focused on the register correction value output section 8 having a construction where a cutting register adjustment value is set for each printing mechanism P in the printing units CT1, CT2, CT3, CT4 and CT5 so that the cutting register is adjusted on each printing mechanism P. If the plate cylinder of each printing mechanism P is set so that printing images on the printing mechanism P are in such a positional relationship that the printing images overlap each other by a shift falling within the range of 2 to 3 millimeters when printing mechanisms of the printing units CT1, CT2, CT3, CT4 and CT5 are driven in accordance with the driving reference, a cutting register adjustment value can be set for a printing mechanism P for printing a predetermined reference register mark, and cutting register adjustment can be carried out for each printing mechanism P by a cutting register correction value determined by a detection signal that detected the reference register mark printed by that printing mechanism P.

Next, set organization information for designating printing units and folding units to be synchronously controlled in accordance with the driving reference of the master control section 1 during printing operation is input from the input control section 11 of the master control section 1. For example, the set organization information for designating the printing units CT1, CT2, CT3, CT4 and CT5 and the folding unit FD shown in FIG. 1 is input into the master control section 1.

With this input, the processing section 12 of the master control section 1 transmits a control range designation message comprising ASCII codes to the slave control section 3 of #11~#18, #21~#28, #31~#38, #41~#48, #51~#58, and #99 and the register correction value output sections 8 of #01~#05 via the master network connecting section 17 and the network line 5.

Figure 6:
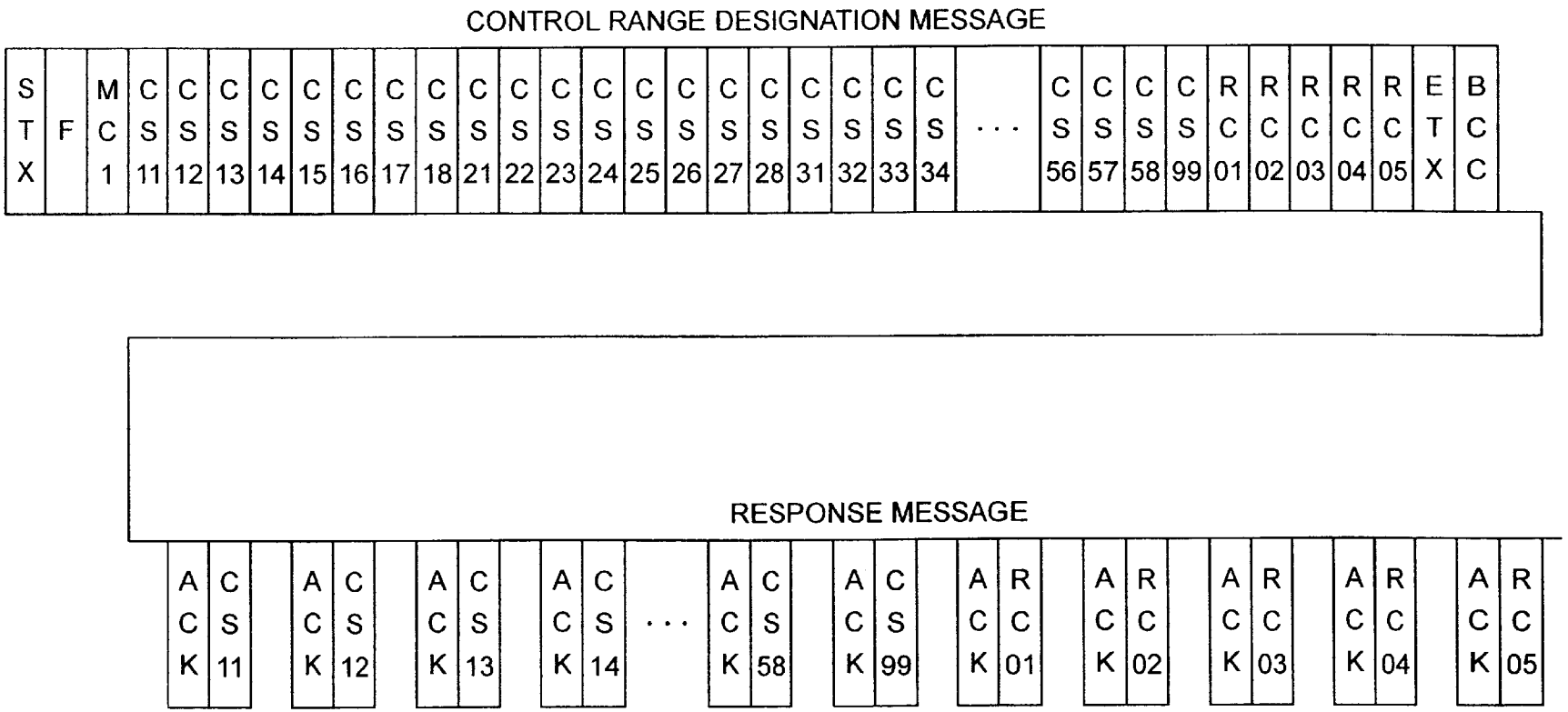
FIG. 6 is a diagram of assistance in explaining a control range designation message and a response message.

FIG. 6 is a diagram of assistance in explaining a control range designation message and a response message. The control range designation message has a text sentence in which (i) "F" denoting that the message is for designating a control range, (ii) "MCI" denoting the master control section 1, and (iii) "CS11" through "CS58" and "CS99" denoting the node numbers of the slave control sections 3 (#11~#18, #21~#28, #31~#38, #41~#48, #51~#58, and #99) for the printing couples and the folding unit that are included in the control range, (iv) "RC01," "RC02," "RC03," "RC04," and "RC05" denoting the node numbers of the register correction value output sections 8 (#01~#05) of the printing units CT1, CT2, CT3, CT4 and CT5 are inserted between a start code "STX" and an end code "ETX" of the message; the text sentence is followed by a block check "BCC," as shown in FIG. 6.

Upon receipt of a control range designation message, the slave network connecting section 31 of the slave control section 3 or the network connecting section 81 of the register correction value output section 8 transmits a response message acknowledging the receipt of the control range designation message to the master control section 1 via the network line 5. The response message comprises "ACK" denoting that it is a response message, and its own code number indicating the responded slave control section 3 or the register correction value output section 8.

Upon receipt of the control range designation message, the first switch 92 of the register correction value output section 8 is brought to the "ON" state, and the second and third switches 93 and 94 thereof to the "OFF" state.

Synchronous control operation is carried out first by changing over the input control section 11 of the master control section 1 to the operation signal input enabled state and inputting operation signals, such as start, acceleration/deceleration, and stop, from the input control section 11.

As operation signals are input, the processing section 12 sets a speed value corresponding to the entered operation signals in the master pulse signal output section 14 of the driving reference setting section 13. With this, the master pulse signal output section 14 outputs a first master pulse signal corresponding to the set speed, and a second master pulse signal every time a predetermined number of the first master pulse signals are output. The first and second master pulse signals are those having frequencies equal to those of the pulse signal output by encoder 6, which is set corresponding to the driving means M, and the Z-phase pulse signal output by the encoder 6, when the rotary press is operated at a set speed.

As the master pulse signal output section 14 begins outputting the aforementioned signals, the speed setting section 15 and the phase setting section 16 of the driving reference setting section 13 integrate the pulse signals output by the master pulse signal output section 14. That is, the speed setting section 15 integrates the first master pulse signals, which are cleared by the second master pulse signal. The phase setting section 16 integrates the first and second master pulse signals, and the integrated value of the first master pulse signals is cleared by the second master pulse signal, while the integrated value of the second master pulse signals is cleared every time the integrated value amounts to a predetermined value.

The predetermined value at which the second master pulse signal is cleared is predetermined based on the ratio of the revolution of the plate cylinder PC to that of the encoder 6 that rotates together with the driving means M. It is "four," for example, when the encoder 6 rotates four turns for one turn of the plate cylinder PC, and "two" when the encoder 6 rotates two turns for one turn of the plate cylinder PC.

The integrated value of the speed setting section 15 and the phase setting section 16 are transmitted as a control message at intervals of a predetermined time, 100 microseconds, for example, from the master network connecting section 17 to the slave control sections included in the control range and the register correction value output section 8 via the network line 5.

FIG. 7 is a diagram of assistance in explaining a control message on the integrated values of the speed setting section 15 and the phase setting sections 16. A control message, for example, has a text sentence in which (i) "P" denoting that this message is a driving reference, (ii) "MC1" denoting the master control section 1, (iii) "CS11"~"CS18," "CS21"~"CS28," "CS31"~"CS38," "CS41"~"CS48," "CS51"~"CS58," and "CS99" denoting the node numbers of the slave control section 3 (#11~#18, #21~#28, #31~#38, #41~#48 and #51~#58, #99) of the printing couples and folding unit FD of the printing units that are included in the control range, CT1, CT2, CT3, CT4 and CT5, (iv) "RC01," "RC02," "RC03," "RC04," and "RC05" denoting the node numbers of the register correction value output sections 8 (#01~#05) of the printing units CT1, CT2, CT3, CT4 and CT5, (v) "V8," "V7," "V6," and "V5" denoting the driving reference speed and "V4," "V3," "V2," and "V1" denoting the driving reference phase are inserted between a start code "STX" and an end code "ETX" of the message; the text sentence is followed by a block check "BCC," as shown in FIG. 7. Note that "V8" through "V1" use ASCII codes (hexadecimal numerals) "0" to "9," and "A" to "F," and the driving reference speed and phase comprise four bytes, for example. These messages are transmitted to the network line 5 at the rate of 20 megabits per second.

In the slave control section 3 of the printing mechanism P where a control message is received, the driving reference speed is input in the driving reference speed signal output section 32, and the driving reference phase is input in the corrected driving reference phase signal output section 46 for further processing. In the driving reference speed signal output section 32 in which the driving reference speed is input, a value S1 proportional to the speed value set by the processing section 12 is calculated using the following equation where the currently input driving reference speed is set as Y2, the driving reference speed input immediately before it as Y1, and the predetermined time interval at which the master control section 1 sends the control message as T, and an analog signal corresponding to this value S1 is output as a drive reference speed signal.

$$S1=(Y2-Y1)/T.$$

As the integrated value of the first master pulse signals of the speed setting section 15 is reset by the second master pulse signal, it may often happen that Y1>Y2, and as a result, S1<0. In such a case, S1 is calculated using the following equation.

$$S1=(Ym+Y2-Y1)/T$$

where Ym is the number of outputs of the first master pulse signals output during the period in which the two successive second master pulse signals are output, which is a predetermined value.

The corrected driving reference phase signal output section 46 corrects the input driving reference phase with the registering value of the register correction value registering section 45 into the corrected driving reference phase, and replaces the immediately before corrected driving reference phase with the corrected driving reference phase of this time, and further outputs the last corrected driving reference phase in the form of an appropriate signal, every time the driving reference phase inputs. The registering value of the register correction value registering section 45 is hold "0" till the register correction value output section 8 outputs the register correction value of other than "0", which is explained in the following.

In the slave control section 3 of the folding unit FD where a control message is received, the driving reference speed is input in the driving reference speed signal output section 32, and the driving reference phase is input in the corrected driving reference phase signal output section 46 for further processing. In the driving reference speed signal output section 32 in which the driving reference speed is input, a value S1 proportional to the speed value set by the processing section 12 is calculated using the following equation where the currently input driving reference speed is set as Y2, the driving reference speed input immediately before it as Y1, and the predetermined time interval at which the master control section 1 sends the control message as T, and an analog signal corresponding to this value S1 is output as a drive reference speed signal.

$$S1=(Y2-Y1)/T.$$

As the integrated value of the first master pulse signals of the speed setting section 15 is reset by the second master pulse signal, it may often happen that Y1>Y2, and as a result, S1<0. In such a case, S1 is calculated using the following equation.

$$S1=(Ym+Y2-Y1)/T$$

where Ym is the number of outputs of the first master pulse signals output during the period in which the two successive second master pulse signals are output, which is a predetermined value.

In the driving reference phase signal output section 33 into which the driving reference phases are input, the previously entered driving reference phase is corrected with the currently entered driving reference phase every time the driving reference phase is entered, and the latest driving reference phase is output in the form of appropriate signals.

Aside from this, in the slave control section 3, a pulse signal and a Z-phase signal output by the encoder 6 connected to the driving means M corresponding to each slave control section 3 are input into the feedback signal receiving section 38, and the pulse signal and the Z-phase pulse signal output by the encoder 6 and input into the feedback signal receiving section 38 are processed in the feedback phase signal output section 37 and the feedback speed signal output section 39, respectively.

The feedback phase signal output section 37 integrates the pulse signals and the Z-phase pulse signal output by the encoder 6, and outputs the integrated values in the form of appropriate signals as a rotational phase value for the driving means M, and the plate cylinder PC that is a driven part of the driving means M. During integration by the feedback phase signal output section 37, the integrated value of pulse signals is cleared by a Z-phase pulse signal, and the integrated value of the Z-phase phase signal is cleared every time the integrated value amounts to a predetermined value. The predetermined value at which the integrated value of the Z-phase pulse signal are cleared is predetermined based on the ratio of the rotation of the plate cylinder PC to that of the encoder 6 that rotates together with the driving means M.

The feedback speed signal output section 39 integrates the pulse signals output by the encoder 6, calculates a value S2 proportional to the rotational speed of the driving means M using the following equation where the integrated value obtained every time the slave network connecting section 31 receives a control message is set as Y4, the integrated value at the time when the immediately preceding control message is received as Y3, and the predetermined time interval at which the master control section 1 transmits control messages as T, and outputs an analog signal corresponding to this value S2 as a driving speed signal.

$$S \ldots Y3\cdot/T.$$

There can be a case where Y3>Y4 and accordingly S2<0 when the integrated value of the pulse signals on the feedback speed signal output section 39 are reset by the Z-phase pulse signal. In such a case, S2 is calculated using the following equation.

$$S2=(Yn+Y4-Y3)/T$$

where Yn is the total number of pulse signal outputs generated by the encoder 6 during the period when the preceding and succeeding two Z-phase pulse signals are output, or a predetermined value of the same number as the number of outputs Ym of the first master pulse signals needed for the second master pulse signals to be output.

In the slave control section 3, drive power for the driving means M is corrected by the motor driver 41 every time the slave network connecting section 31 receives a control message. The details are as follows:

The corrected driving reference phase signal output section 46 corrects the received driving reference phase with the registered value of the register correction value registering section 45 into a corrected driving reference phase, and outputs a corrected driving reference phase signal every time the slave network connecting section 31 receives a driving reference in a control message, as described above. The corrected driving reference phase signal is input into the phase difference detecting section 34. The rotational phase value of the driving means M, and the plate cylinder PC that is a driven part of the driving means M output by the feedback phase signal output section 37 is input into the phase difference detecting section 34 in the form of a feedback phase signal.

The phase difference detecting section 34 calculates a difference between the corrected driving reference phase and the rotational phase of the driving means M, and a difference between the corrected driving reference phase and the rotational phase of the plate cylinder PC that is a driven part of the driving means M, based on the corrected driving reference phase signal and the feedback phase signal every time a corrected driving reference phase signal is input, and outputs the calculated difference into the phase difference signal output section 35 that is an integration amplifier. With this, the phase difference signal output section 35 outputs an analog signal corresponding to the difference as a phase difference signal.

Every time the slave network connecting section 31 receives a driving reference included in a control message, the driving reference speed signal that is output by the driving reference speed signal output section 32 is corrected with the phase difference signal in the first speed signal correcting section 36 into a first corrected speed signal, and then further corrected in the second speed signal correcting section 40 with the driving reference speed signal indicating the driving speed of the driving means M output by the feedback speed signal output section 39 into a second corrected speed signal. The second corrected speed signal is input into a motor driver 41

The motor driver 41 into which the second corrected speed signal is input corrects the drive power being supplied to the driving means M so as to match with the second corrected speed signal.

With the above control, the plate cylinder PC of each printing mechanism P that is within the control range of the master control section 1 is synchronously controlled so as to be driven in such a manner as to match with the corrected driving reference phase and the driving reference speed, whereas the folding cylinder FC in the folding unit FD that is a cutting mechanism is synchronously controlled so as to be driven in such a manner as to match with the driving reference phase and the driving reference speed.

Upon receipt of a control message from the master control section 1, on the other hand, the register correction value output section 8 sets a register correction value in the following manner, and transmits it to the slave control section 3 of the printing mechanism P. That is, in the register correction value output section 8 that receives the control message from the master control section 1, the driving reference phase is input into the driving reference phase signal output section 82 for further processing.

The driving reference phase signal output section 82 into which the driving reference phase is input, replaces the immediately preceding driving reference phase with the currently input driving reference phase every time the driving reference phase is input, and outputs the latest driving reference phase in the form of an appropriate signal.

Then, the cutting register correction value output section 84 adjusts the latest driving reference phase with the cutting register adjustment value set and registered in the cutting register adjustment value registering section 83, by subtracting the cutting register adjustment value from the driving reference phase, for example, to obtain a cutting register correction value every time the latest driving reference phase is input. Every time the mark detecting section 7, which will be described later, detects a register mark, the cutting register correction value output section 84 outputs in the form of an appropriate signal the cutting register correction value at that point of time as a cutting register correction value for the plate cylinder PC that prints the register mark. When the cutting register correction value obtained by subtracting the cutting register correction value from the driving reference phase is smaller than "0", the number of outputs Ym (predetermined value) of the first master pulse signals output during a period in which the master pulse signal output section 14 outputs the two successive second master pulse signals is added to the cutting register correction value to obtain a new cutting register correction value.

The cutting register correction value output by the cutting register correction value output section 84 is registered in the cutting register correction value registering section 85 for each register mark, that is, for each plate cylinder PC that prints the register mark.

The cutting register correction value registered in the cutting register correction value registering section 85 is determined as the cutting register correction value determination section 90 turns "OFF" the first switch 92 to discontinue the input of the cutting register correction value from the cutting register correction value output section 83. The cutting register correction value determination section 90 turns "OFF" the first switch 92 and turn "ON" the second switch 93.

By turning "ON" the second switch 93, the cutting register correction value registering section 85 is connected to the register value processing section 86. The register correction value processing section 86 regards the cutting register correction value relating to each register mark registered in the cutting register correction value registering section 85 as the register correction value for the plate cylinder PC that prints the register marks, and transmits it to the slave control section 3 of the corresponding printing mechanism P via the register correction value transmitting section 87.

As described above, however, the second and third switches 93 and 94 remain in the "OFF" state at the start of control with this system, while the register correction value processing section 86 receives no values as the register correction value and the register correction value output section 8 transmits the register correction value of "0." The cutting register correction value registered in the cutting register correction value registering section 85 is not stabilized in the initial stages of control for the above reasons because the traveling tension exerted on the paper web W in the rotary press is not stabilized at the start of control. Control is effected so as to transmit the register correction value of "0" at the start of control to wait until the cutting register correction value is stabilized to a proper level.

The slave control section 3 of the printing mechanism P to which the cutting register correction value has been transmitted as a register correction value for the plate cylinder PC from the register correction value output section 8 synchronously drives the plate cylinder PC with the aforementioned processing and control so as to match with the corrected driving reference phase by the cutting register correction value and with the driving reference speed as well. As a result, the timing at which the register marks printed by the plate cylinder PC are detected by the corresponding mark detecting sections 7 is almost agreed with each other, and the cutting position on the paper web W is almost agreed with the proper position at which the web is cut. That is, the cutting register correction value output by the cutting register correction value output section 84 at the time when the mark detecting section 7 has detected the register mark becomes "0" in the register correction value output section 8.

When the cutting register correction value output by the cutting register correction value output section 84 at the time when the register mark has been detected by the mark detecting section 7 becomes "0", the cutting register matching detecting section 91 detects it and outputs a cutting register matching signal, and turns "ON" the third switch 94.

As the third switch 94 is turned "ON," the printing register correction value output section 89 is connected to the register correction value processing section 86, and the printing register correction value relating to the register mark is input every time the mark detecting section 7 detects the register mark. The register correction value processing section 86 then merges the cutting register correction value registered in the cutting register correction value registering section 85 with the printing register correction value relating to the register mark, and transmits it as a register correction value for the plate cylinder that prints the register mark to the slave control section 3 of the corresponding printing mechanism P via the register correction value transmitting section 87.

The slave control section 3 of the printing mechanism P, to which the register correction value output section 8 has transmitted the value to which the cutting register correction value and the printing register correction value were merged as a register correction value for the plate cylinder PC, synchronously drives the plate cylinder PC with the aforementioned processing and control so as to match with the corrected driving reference phase obtained by merging the cutting register correction value and the printing register correction value, and with the driving reference speed as well. As a result, the register marks printed by the plate cylinders are printed exactly at proper locations with respect to the reference register mark. That is, printing images are printed by the plate cylinders of the printing mechanisms in an accurately superposed state.

Transmission of register correction values from the register correction value output section 8 to the slave control section 3 of the printing mechanism P is carried out with control messages.

Figure 8:
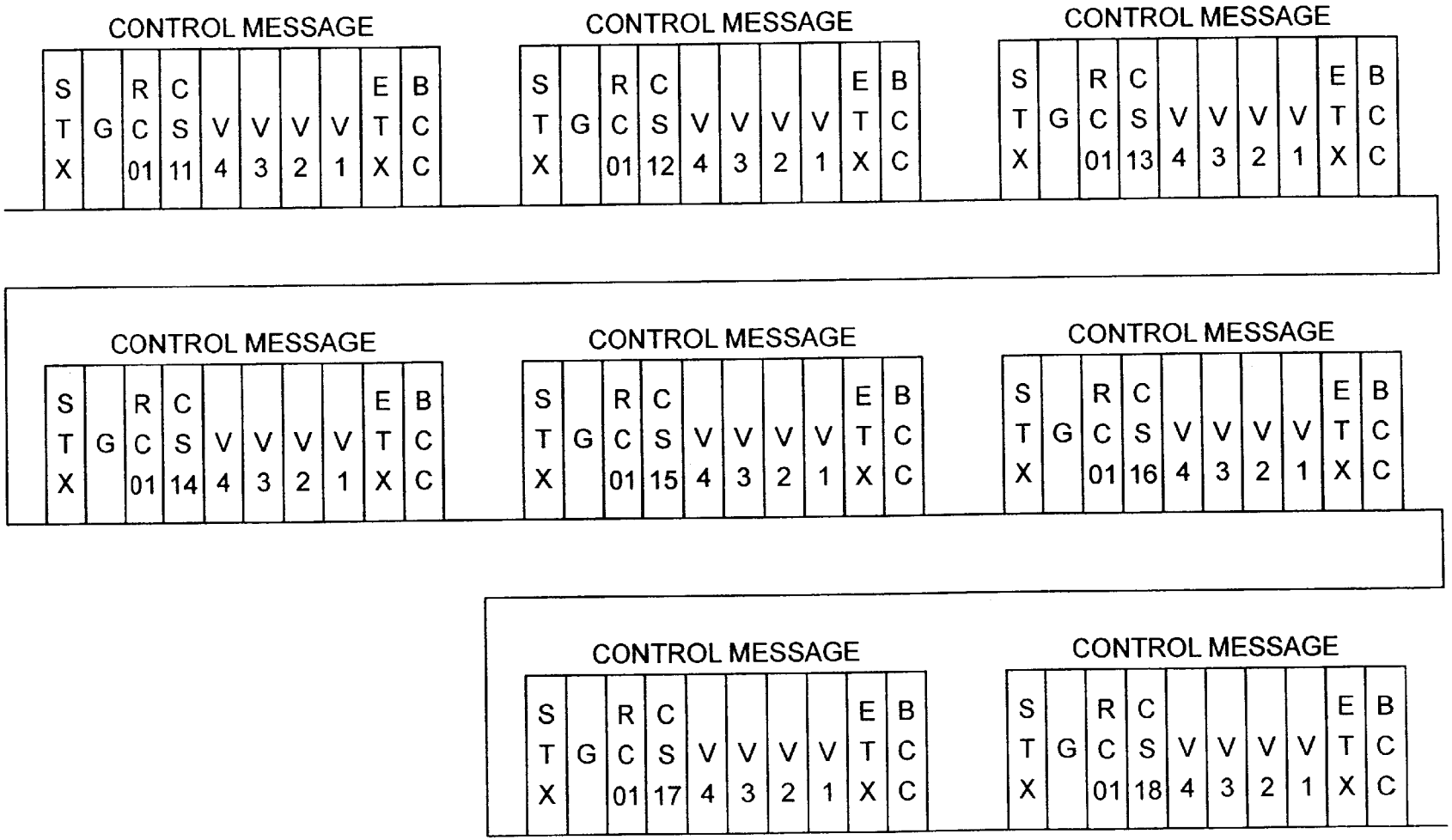
FIG. 8 is a diagram of assistance in explaining a control message of a register correction value output and transmitted by the register correction value output section.

FIG. 8 is a diagram of assistance in explaining control messages for register correction values to be transmitted by the register correction value output section 8. A control message has a text sentence in which (i) "G" denoting that the message is concerned with a register correction value, (ii) "RC01" ("RC02," "RC03," "RC04," or "RC05," in this explanation FIG. 8 shows "RC01" only.) denoting the node number of the register correction value output section 8 of any of the transmission sources #01~#05, and (iii) "CS11"~"CS18" ("CS21"~"CS28," "CS31" "CS38," "CS41"~"CS48," or "CS51"~"CS58," in this explanation FIG. 8 shows "CS11"~"CS18" only.) denoting the node numbers of any slave control sections 3 (#11~#18, #21~#28, #31~#38, #41~#48, and #51~#58) for the printing couples of the printing units CT1, CT2, CT3, CT4 and CT5 that are destinations, and (iv) "V4," "V3," "V2," and "V1" denoting the register correction values are inserted between a start code "STX" and an end code "ETX" of the message; and the text sentence is followed by a block check "BCC." Note that "V4" through "V1" use ASCII codes (hexadecimal numerals) "0" to "9," and "A" to "F," and the register correction value in the message shown comprise four bytes, for example. These messages are transmitted to the transmission line 95 at the rate of 20 megabits per second.

In the system of the embodiment shown in the figures, the printing mechanisms P and the folding unit FD that is a cutting mechanism, both included in the control range of the master control section 1, are driven in such a manner that both match with the driving reference speed, the rotational phase of the plate cylinders of the printing mechanisms P is driven and turned so that the cutting register matches with the rotational phase of the folding cylinder FC of the folding unit FD that is the cutting mechanism. Further continuously, the rotational phase of the plate cylinder FC of each printing mechanism P is driven and turned so that the printing image of the plate cylinder PC printing the reference register mark overlaps correctly printing images printed with another plate cylinder PC. That is, the rotational phase is driven and turned for the printing registers to be matched each other.

That is, synchronous control is accomplished with the present invention in which speed is matched with each other, and cutting register and printing register are matched with each other.

As described above, the present invention makes it possible, in a rotary press using a paper web, to continuously and automatically adjust cutting register to adjust the cutting position by the folding unit or the sheeter, for example, to the desired position with respect to the printing position, and printing register to adjust the state of superposition of printing images of each color in multi-color printing to the desired state, based on the detection of predetermined printing marks. Consequently, the present invention can eliminate the need for skills and reduce time in cutting and printing register adjustment operations, contributing to a reduction in spoilage caused in these operations.

What is claimed is:

1. A synchronous control system having automatic cutting and printing register adjusting functions for a rotary press comprising a plurality of printing mechanisms provided for multi-color printing on a paper web, at least one cutting mechanism for cutting the multi-color printed paper web into predetermined units of printing images; the printing mechanisms and the cutting mechanism being driven separate driving means, and a control section for controlling the driving means, the improvement comprising:

a driving reference setting section for setting a driving reference comprising a driving reference speed and a driving reference phase, a feedback signal output section for outputting a first pulse signal proportional to the amount of angular displacement caused by the rotation of the driving means, and a second pulse signal for one turn of the driving means, a mark detecting section for detecting a predetermined mark printing by each printing mechanism at a predetermined position, and a register correction value output section that can set and register a cutting register adjustment value based on the length of the paper web from the position at which the mark is detected by the mark detecting section to the cutting position by the cutting mechanism, and the cutting unit length, receive a detection signal from the mark detecting section and a driving reference phase from the driving reference setting section, using a value obtained by adjusting the driving reference phase with the cutting register adjustment value, adjust the driving reference phase at the time when the mark was detected by the mark detecting section with the cutting register adjustment value, set the adjusted value as a cutting register correction value, detect a shift in printing register of the other printing image with respect to a printing image that is a reference, set a printing register correction value based on the shift, output a register correction value based on the cutting register correction value and the printing register correction value;

the control section for controlling driving sections of the printing mechanisms controlling so that a corrected driving reference phase obtained by correcting the driving reference phase with the register correction value is synchronized with a feedback phase of the plate cylinder driven by each driving means.

2. A synchronous control system having automatic cutting and printing register adjusting functions as set forth in claim 1 wherein the control section is a slave control section subordinate to a master control section; the master control section adapted to set and transmit a driving reference comprising a driving reference speed and a driving reference phase.

3. A synchronous control system having automatic cutting and printing register adjusting functions for a rotary press comprising a plurality of printing mechanisms provided for multi-color printing on a paper web, at least one cutting mechanism for cutting the multi-color printed paper web into predetermined units of printing images, the printing mechanisms and the cutting mechanism being driven by separate driving means, and a control section for controlling the driving means, the improvement comprising:

a driving reference setting section for setting a driving reference comprising a driving reference speed and a driving reference phase;

a feedback signal output section for outputting a first pulse signal proportional to the amount of angular displacement caused by the rotation of the driving means, and a second pulse signal for one turn of the driving means;

a mark detecting section for detecting a predetermined mark printed by each printing mechanism at a predetermined position;

a register correction value output section that can set and register a cutting register adjustment value based on the length of the paper web from the position at which the mark is detected by the mark detecting section to the cutting position by the cutting mechanism, and the cutting unit length, receive a detection signal from the mark detection section and a driving reference phase from the driving reference setting section, using a value obtained by adjusting the driving reference phase with the cutting register adjustment value, adjust the driving reference phase at the time when the mark was detected by the mark detecting section with the cutting register adjustment value, set the adjusted value as a cutting register correction value, detect a shift in printing register of the other printing image with respect to a printing image that is a reference, set a printing register correction value based on the shift, output a register correction value based on the cutting register correction value and the printing register correction value;

a feedback signal receiving section for receiving a signal output by the feedback signal output section;

a feedback speed signal output section for outputting a feedback speed signal for the driving means based on the first pulse signal received by the feedback signal receiving section; and a feedback phase signal output section for outputting a feedback phase signal for plate cylinders driven by the driving means based on the first and second pulse signals received by the feedback signal receiving section, the control section for controlling driving sections of the printing mechanisms controlling so that a corrected driving reference phase obtained by correcting the driving reference phase with the register correction value is synchronized with a feedback phase of the plate cylinder driven by each driving means.

4. A synchronous control system having automatic cutting and printing register adjusting functions as set forth in claim 3 wherein the control section is a slave control section subordinate to a master control section; the master control section adapted to set and transmit a driving reference comprising a driving reference speed and a driving reference phase.

5. A synchronous control system having automatic cutting and printing register adjusting functions for a rotary press comprising a plurality of printing mechanisms provided for multi-color printing on a paper web, at least one cutting mechanism for cutting the multi-color printed paper web into predetermined units of printing images, the printing mechanisms and the cutting mechanism being driven by separate driving means, and a control section for controlling the driving means, the improvement comprising:

a driving reference setting section for setting a driving reference comprising a driving reference speed and a driving reference phase;

a feedback signal output section for outputting a first pulse signal proportional to the amount of angular displacement caused by the rotation of the driving means, and a second pulse signal for one turn of the driving means;

a mark detecting section for detecting a predetermined mark printed by each printing mechanism at a predetermined position;

a register correction value output section that can set and register a cutting register adjustment value based on the length of the paper web from the position at which the mark is detected by the mark detecting section to the cutting position by the cutting mechanism, and the cutting unit length, receive a detection signal from the mark detection section and a driving reference phase from the driving reference setting section, using a value obtained by adjusting the driving reference phase with the cutting register adjustment value, adjust the driving reference phase at the time when the mark was detected by the mark detecting section with the cutting register adjustment value, set the adjusted value as a cutting register correction value, detect a shift in printing register of the other printing image with respect to a printing image that is a reference, set a printing register correction value based on the shift, output a register correction value based on the cutting register correction value and the printing register correction value;

a mark position calculating section for calculating a barycentric position of each mark from a detection signal output by the mark detecting section; and a printing register correction value output section for calculating a difference between the barycentric positions of the other marks and what should be barycentric positions for them with respect to the barycentric position of a predetermined reference mark, and outputting the difference as a printing register correction value, the control section for controlling driving sections of the printing mechanisms controlling so that a corrected driving reference phase obtained by correcting the driving reference phase with the register correction value is synchronized with a feedback phase of the plate cylinder driven by each driving means.

6. A synchronous control system having automatic cutting and printing register adjusting functions as set forth in claim 5 wherein the control section is a slave control section subordinate to a master control section; the master control section adapted to set and transmit a driving reference comprising a driving reference speed and a driving reference phase.

7. A synchronous control system having automatic cutting and printing register adjusting functions for a rotary press comprising a plurality of printing mechanisms provided for multi-color printing on a paper web, at least one cutting mechanism for cutting the multi-color printed paper web into predetermined units of printing images, the printing mechanisms and the cutting mechanism being driven by separate driving means, and a control section for controlling the driving means, the improvement comprising:

a driving reference setting section for setting a driving reference comprising a driving reference speed and a driving reference phase;

a feedback signal output section for outputting a first pulse signal proportional to the amount of angular displacement caused by the rotation of the driving means, and a second pulse signal for one turn of the driving means;

a mark detecting section for detecting a predetermined mark printed by each printing mechanism at a predetermined position; and a register correction value output section that can set and register a cutting register adjustment value based on the length of the paper web from the position at which the mark is detected by the mark detecting section to the cutting position by the cutting mechanism, and the cutting unit length, receive a detection signal from the mark detection section and a driving reference phase from the driving reference setting section, using a value obtained by adjusting the driving reference phase with the cutting register adjustment value, adjust the driving reference phase at the time when the mark was detected by the mark detecting section with the cutting register adjustment value, set the adjusted value as a cutting register correction value, detect a shift in printing register of the other printing image with respect to a printing image that is a reference, set a printing register correction value based on the shift, output a register correction value based on the cutting register correction value and the printing register correction value, the control section for controlling the driving means of the printing mechanism generating a control signal by correcting a driving reference speed signal with a signal relating to a difference between a corrected driving reference phase and a feedback phase from a plate cylinder, and controlling the driving means with the control signal so that a corrected driving reference phase obtained by correcting the driving reference phase with a register correction value is synchronized with a feedback phase of a plate cylinder driven by each of the driving means.

8. A synchronous control system having automatic cutting and printing register adjusting functions set forth in claim 7 wherein the control section is a slave control section subordinate to a master control section; the master control section adapted to set and transmit a driving reference comprising a driving reference speed and a driving reference phase.

* * * * *